US005759052A

United States Patent [19]

Seki

[11] Patent Number: 5,759,052

[45] Date of Patent: Jun. 2, 1998

[54] JOINT CONNECTOR

[75] Inventor: Yoshinobu Seki, Shizuoka, Japan

[73] Assignee: Yazaki Corporation, Tokyo, Japan

[21] Appl. No.: 522,152

[22] Filed: Aug. 31, 1995

Related U.S. Application Data

[63] Continuation-in-part of Ser. No. 262,446, Jun. 20, 1994, abandoned.

[30] Foreign Application Priority Data

| | | | |
|---|---|---|---|
| Jun. 18, 1993 | [JP] | Japan | 5-170976 |
| Jun. 7, 1994 | [JP] | Japan | 6-125428 |
| Aug. 31, 1994 | [JP] | Japan | 6-207144 |

[51] Int. Cl.[6] ..... H01R 29/00

[52] U.S. Cl. ..... 439/189; 439/595; 439/708

[58] Field of Search ..... 439/49, 189, 507–513, 439/747, 595, 708

[56] References Cited

U.S. PATENT DOCUMENTS

| | | | |
|---|---|---|---|
| 4,801,278 | 1/1989 | Sappington | 439/746 |
| 5,007,888 | 4/1991 | Goutiere | 439/189 |

FOREIGN PATENT DOCUMENTS 63-79083 5/1988 Japan .

*Primary Examiner*—Neil Abrams

*Attorney, Agent, or Firm*—Morgan, Lewis & Bockius LLP

[57] ABSTRACT

A joint connector including a plurality of terminals received in a connector housing designed such that the length of the terminals, and hence the length of the connector housing, is minimized to provide a compact arrangement. The joint connector includes the connector housing accommodating a plurality of terminals including bus bar connecting portions, and a bus bar having terminal connecting portions arranged in correspondence with the terminals. Each of the bus bar connecting portions of the terminals has a planar piece, while each of the terminal connecting portions of the bus bar has a slit, or vice versa. The planar pieces are fixedly engaged in the slits so that the bus bar connecting portions of the terminals are electrically connected to the terminal connecting portions of the bus bar, respectively. According to one embodiment the bus bar connecting portions of the terminals is L-shaped. In another embodiment, the bus bar connecting portions includes a base plate from which a pair of planar pieces extend and are joined together to form a laminated bus bar connecting portion.

17 Claims, 12 Drawing Sheets

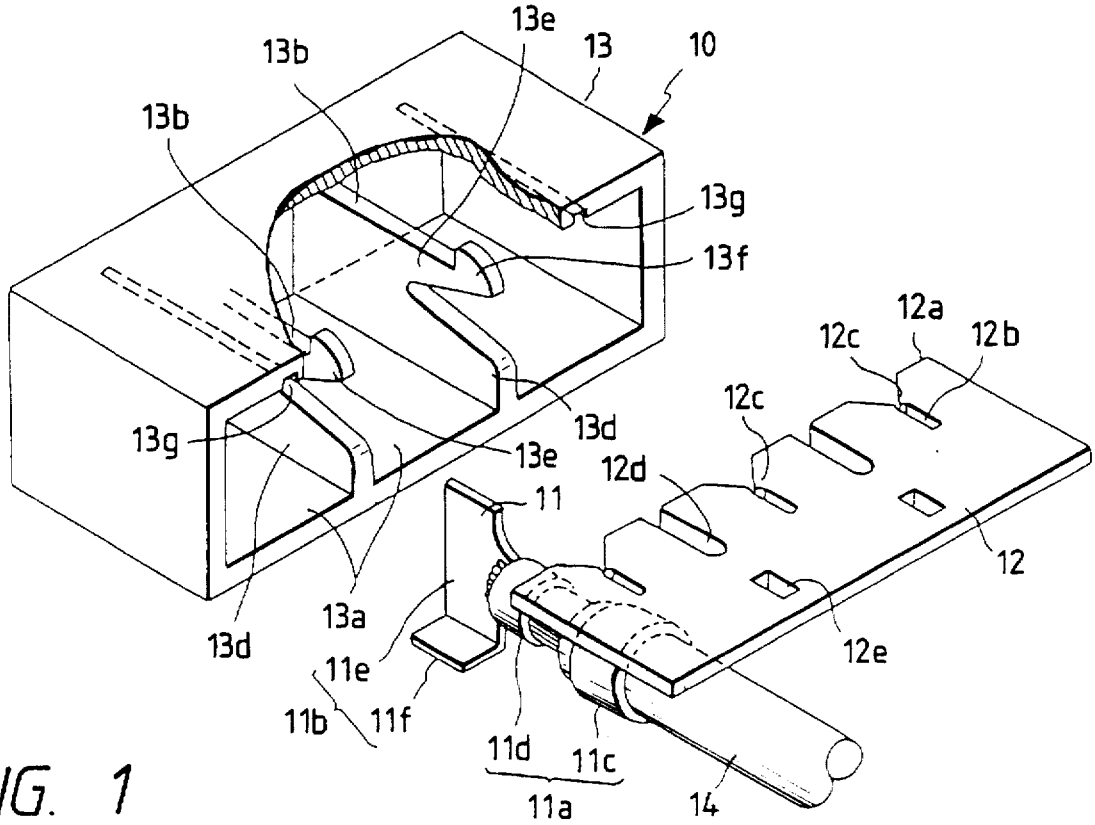
FIG. 1
FIG. 3
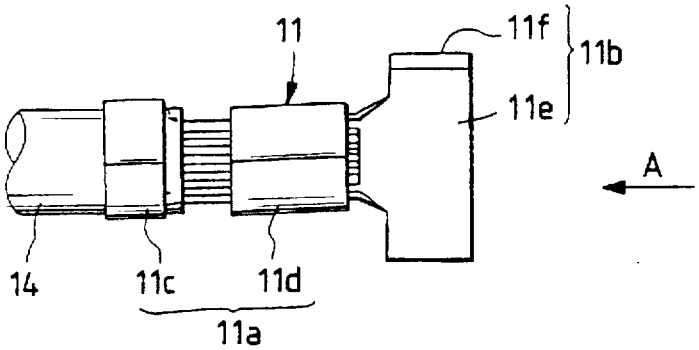
FIG. 4
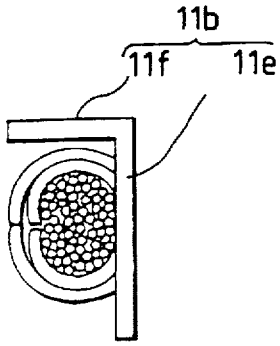

JOINT CONNECTOR

This is a continuation-in-part of application Ser. No. 08/262,446 filed on Jun. 20,1994 and now abandoned.

BACKGROUND OF THE INVENTION

1. Field of the Invention

This invention relates to a joint connector for connecting a plurality of terminals accommodated in a connector housing to one another through a bus bar.

2. Related Art

Joint connectors are used for interconnecting terminals to each other through a bus bar to enable one signal path to branch into many different paths. Such connectors are often used in the electrical system of an automobile.

FIGS. 19 through 22 show a conventional joint connector which has been disclosed in unexamined Japanese Utility Patent Application No. 79083/1988. The conventional joint connector comprises: a plurality of terminals 1 each having a wire connecting portion 1*a* at the rear end, and a bus bar connecting portion 1*b* at the front end which is electrically connected to a bus bar 2; a connector housing 3 including terminal accommodating sections 3*a* for accommodating the plurality of terminals 1, and a bus bar accommodating section 3*b*; the aforementioned bus bar 2 accommodated in the bus bar accommodating section 3*b*, for electrically connecting the plurality of terminals to one another; and electric wires 4 which are respectively connected to the wire connecting portions 1*a* of the terminals 1.

The terminals 1 are commonly referred to as "crimping terminals", which are formed by subjecting a metal plate, which is elastic and high in electrical conductivity, to a series of plate working operations such as blanking and bending. Each of the above mentioned wire connecting portions 1*a* , as shown in FIG. 19, includes a cover fixing piece 1*c* which is crimped over the insulating cover of the wire 4 to fixedly hold it, and a connecting piece 1*d* which is crimped over the exposed conductor of the wire 4 so as to be electrically connected thereto. The bus bar connecting portion 1*b* is bent to form an elastic contact piece 1*e* which is designed to elastically retain the respective terminal connecting portion 2*a* (described later) of the bus bar 2.

The bus bar 2 is made of a metal plate which is high in electrical conductivity. Referring to FIG. 22, the bus bar 2 includes a plurality of the aforementioned terminal connecting portions 2*a* which are received by the elastic contact pieces 1*e* of the terminals 1, thus being electrically connected to the latter 1. The terminal connecting portions 2*a* are arranged like the teeth of a comb in correspondence to the terminals in the connector housing 3.

The connector housing 3 is formed by molding a synthetic resin having a high insulation resistance. As shown in FIG. 19, the connector housing 3 is shaped in the form of a rectangular box which includes terminal the accommodating sections 3*a* arranged side by side and a bus bar accommodating section 3*b* disposed above the terminal accommodating section 3*a*. Both the terminal accommodating sections 3*a* and the bus bar accommodating section 3*b* have openings in one end face of the housing (in the upper end face in FIG. 19). The terminals 1 and the bus bar 2 are inserted into the respective accommodating sections through those openings.

The terminal accommodating sections 3*a* have elastic locking protrusions 3*c* which, when the terminals 1 have been inserted therein a predetermined amount, engage with engaging recesses 1*f* formed in the terminals 1, to prevent the terminals 1 from being inadvertently withdrawn from the connector housing. The base end portion of the bus bar 2 (where the terminal connecting portions 2*a* are coupled to one another), as shown in FIGS. 21 and 22, is buried in a spacer 5 made of a synthetic resin having a high insulation resistance. The spacer 5 serves to retain the bus bar 2 in the bus bar accommodating section 3*b* in a predetermined position in which the terminal connecting portions 2*a* are engaged with the elastic contact pieces 1*e*. The spacer 5 comprises a covering portion 5*a* which covers the base end portion of the bus bar 2 so as to allow only the terminal connecting portions 2*a* to contact the terminals 1, a pair of arm members 5*b* and 5*b* which protrude upwardly from both ends of the covering portion 5*a* and a stopper 5*c* which protrudes upwardly from the rear edge of the covering portion 5*a*.

As shown in FIG. 19, when the bus bar 2 has been inserted into the bus bar accommodating section 3*b* to the predetermined position, the front end face 5*d* of the covering portion 5*a* abuts against the rear ends of the elastic contact pieces 1*e* of the terminals so that the terminals 1 are positively fixed in the terminal accommodating sections 3*a*.

The arm members 5*b* extends downwardly from the front edge of the covering portion 5*a*. A distal end of each arm member 5*b* includes an engaging projection 5*e* which is received by an engaging hole 3*d* provided in a peripheral wall of the connector housing 3 to retain the bus bar in the predetermined position.

On the other hand, when the bus bar 2 has been inserted in the bus bar accommodating section 3*b* to the predetermined position, the stopper 5*c* of the spacer 5 serves as positioning means; that is, the stopper abuts against the end face of the connector housing 3 in which the openings are formed. In addition, the stopper 5*c* may be used as a handle to pull the bus bar 2 out of the bus bar accommodating section 3*b*.

With such a conventional joint connector, the configuration and size of the elastic contact pieces 1*e* of the bus bar connecting portions 1*b* are limited to that which will ensure that the elastic contact pieces 1*e* have the necessary elasticity to securely retain the bus bar 2. Hence, the length (the vertical dimension in FIG. 19) of the bus bar connecting portion 1*b* is unavoidably large, and the total length of the terminal 1 and connector housing is attendantly long, as also shown in FIG. 20. As a result, the joint connector occupies a relatively large space.

Furthermore, the configuration of the terminals is relatively intricate resulting in high manufacturing costs.

SUMMARY OF THE INVENTION

In view of the foregoing, an object of the invention is to provide a joint connector in which the terminals are decreased in length so that the connector housing is likewise decreased in length, and the space occupied by the joint connector is decreased. Another object of the invention is to provide a terminal having a simplified configuration to thereby reduce the associated manufacturing costs.

It is another object of the invention to provide a joint connector in which multiple poles can be easily realized without requiring special measures for increasing the rigidity of an outer circumferential wall, terminals can be mounted in a higher density so as to facilitate miniaturization, a sufficient thickness as a bus bar connecting portion which is fitted into a slit portion of the bus bar can be ensured, and a low production cost can be realized by reducing the costs for the press dies and the working processes.

The foregoing object of the invention has been achieved by the provision of a joint connector comprising: a plurality of terminals each having a wire connecting portion at the base end and a bus bar connecting portion at the front end which is electrically connected to a bus bar; and a connector housing including terminal accommodating sections in which the terminals are accommodated in line and a bus bar accommodating section in which the bus bar is accommodated. The bus bar includes a plurality of terminal connecting portions arranged in correspondence with the terminals to enable the terminals to be electrically connected to each other via the bus bar.

The joint connector of the invention for attaining the above-mentioned objective includes: a plurality of terminals in each of which an electric wire connecting portion is disposed on a basal-end side and a bus bar connecting portion having a flat plate shape to be electrically connected to a bus bar is disposed on a tip-end side; a connector housing having terminal accommodating portions for accommodating the plurality of terminals in an aligned manner, and a bus bar accommodating portion; and a bus bar which is accommodated in the bus bar accommodating portion and electrically interconnects the plurality of terminals, the bus bar having a structure in which a plurality of terminal connecting portions to be engaged with the bus bar connecting portions of the terminals and electrically conductive with the terminals are combined with each other corresponding to an arrangement of the terminals in the connector housing, an electrical connection between the bus bar connecting portions of the terminals and the terminal connecting portions of the bus bar being attained by tightly fitting the bus bar connecting portions having a flat plate shape into slit portions formed in the terminal connecting portions, wherein the terminal accommodating portions formed in the connector housing has a structure in which a pair of terminal accommodating portions are vertically juxtaposed and communicated with each other, the pair of terminal accommodating portions accommodating and holding a pair of terminals in a condition where bus bar connecting portions of the pair of terminals are in close contact in a back-to-back manner, and the bus bar connecting portions which are in close contact in a back-to-back manner are sandwiched by one of the slit portions of the terminal connecting portions of the bus bar.

In the joint connector, a tip end portion of the terminal has an L-shape in a transverse cross section, one of flat plate portions which constitute the L-shape is used as the bus bar connecting portion which is to be engaged with the terminal connecting portion of the bus bar, and the other flat plate portion which constitutes the L-shape is used as a retaining portion which is to be engaged with an elastic engagement projection protruding into the terminal accommodating portion of the connector housing.

In the joint connector, the bus bar has protruding elastic engagement pieces disposed at both side ends, and the engagement pieces are to be respectively engaged with engagement pieces formed on housing side wall portions corresponding to the bus bar accommodating portion, thereby preventing the bus bar from slipping out from the connector housing.

According to the invention, each of the bus bar connecting portions of the terminals has a flat piece, while each of the terminal connecting portions of the bus bar has a slit in which the flat piece is received, or vice versa.

In more detail, each of the bus bar connecting portions of the terminals is L-shaped in the section having first and second flat pieces, and locking protrusions are formed in the terminal accommodating sections of the connector housing. The first flat pieces of the terminals are engaged with the terminal connecting portions of the bus bar, while the second flat pieces of the terminals are engaged with the locking protrusions in the terminal accommodating sections of the connector housing, thus preventing the terminals from being withdrawn from the connector housing inadvertently.

Furthermore, in order to achieve the object of the invention, the front end portion of each of the terminals includes: a flat-plate-shaped base plate portion which is inserted into the respective terminal accommodating section of the connector housing while being slid along the bottom wall of the terminal accommodating section; and a bus bar connecting portion having a laminated structure which is formed by uniting a pair of plate pieces extended from both sides of the base plate portion on top of each other, thus serving as a flat plate portion having a relatively large thickness which is engaged with the a slit formed in the respective terminal connecting portion of the bus bar. The bus bar connecting portion is so positioned that the center of the bus bar connecting portion in the direction of wall thickness thereof is in alignment with the center of an electrical wire which is fixedly held by the wire connecting portion.

In addition, in order to achieve the object of the invention, in the joint connector, the base plate portion of the front end portion of each terminal has a locking hole which, when the terminal has been inserted to a predetermined position in the respective terminal accommodating section in the connector housing, is engaged with a locking protrusion formed on the bottom of the terminal accommodating section, in such a manner that the central line of the locking hole is aligned with the central axis of an electrical wire fixedly connected to the terminal connecting portion of the terminal. Moreover, in order to achieved the object of the invention, in the joint connector,the bus bar is buried in a spacer made of insulating resin.

The joint connector of the present invention functions in the following manner. According to the invention, the flat pieces of the terminals are fixedly engaged with the slits of the bus bar so that the terminals are electrically connected to the bus bar. Hence, the front end portions of the terminals are considerably simple in configuration, and the terminals are smaller in length than the terminals in the conventional joint connector which have the intricately bent elastic contact piece at the front end.

Furthermore, the bus bar connecting portions of the terminals are made L-shaped. Hence, the front end portions of the terminals are high in mechanical strength, while at the same time having a simple configuration.

In addition, in the joint connector, the front end portion of each of the terminals comprises: the flat-plate-shaped base plate portion which is inserted into the respective terminal accommodating section of the connector housing while being slid on the bottom of the terminal accommodating section; and the bus bar connecting portion of a lamination structure which is formed by joining the two plate pieces extended from both sides of the base plate portion on top of each other, thus serving as the flat plate portion relatively large in thickness which is engaged with the slit formed in the respective terminal connecting portion of the bus bar. Accordingly, the flat-plate-shaped bus bar connecting portion is larger in thickness than the plate material used to form the terminal. Hence, the width of the slits formed in the bus bar, which are engaged with the bus bar connecting portions of the terminal, is increased; that is, the slits can be readily formed for instance by blanking.

Moreover, in the joint connector, the bus bar connecting portion is so positioned that the middle of the bus bar connecting portion in the direction of the wall thickness thereof, is in alignment with the central axis of an electrical wire fixedly held by the wire connecting portion. Hence, in each of the terminal accommodating sections, the terminal can be positioned symmetrically with respect to the central axis of the terminal accommodating section (i.e., the position of the slit of the bus bar). As is apparent from comparison with the case where the end portion of each of the terminals is L-shaped, the gaps provided on both sides of the terminal in each of the terminal accommodating sections are uniform, and, therefore, the configuration of the connector housing is significantly improved.

In addition, in the joint connector, the base plate portion of the front end portion of each of the terminals has the locking hole which, when the terminal has been inserted into the respective terminal accommodating section to the predetermined position, is engaged with the locking protrusion which is formed on the bottom of the terminal accommodating section in such a manner that the central line of the locking hole is in alignment with the central axis of the electrical wire fixedly connected to the terminal connecting portion of the terminal.

In this case, the flat-plate-shaped bus bar connecting portion of the terminal, the slit of the bus bar, and the wire fixedly connected to the base end portion of the terminal are in alignment with one another.

Therefore, even when a tensile force acts on the wire, a minimal torsional force is applied to the front end portion of the terminal. That is, the end portions of the terminals retain their high mechanical strength, and experience only minimal deformation as a result of such a tensile force.

According to the construction of the invention, the bus bar accommodating portion for accommodating and holding the bus bar can be located at the middle position of the pair of upper and lower terminal accommodating portions disposed in the connector housing, and remote from the outer circumferential wall of the connector housing. Accordingly, the upper and lower outer circumferential walls can have a structure in which partition walls for separating the horizontally adjacent terminal accommodating portions are projected. The partition walls function as reinforcing ribs, so as to enhance the rigidity of the outer circumferential walls, and to prevent the deflection of the outer circumferential walls.

In addition, a number of terminals which are arranged in upper and lower two lines can be electrically interconnected by one bus bar, and each pair of upper and lower terminals are accommodated and held in the terminal accommodating portion in a condition where their bus bar connecting portions are overlapped with each other. Accordingly, the arrangement pitch of the terminals in the vertical direction can be reduced, so that it is possible to mount terminals in a higher density, thereby facilitating miniaturization of the connector.

Moreover, the bus bar connecting portions of the pair of upper and lower terminals are in close contact in a back-to-back manner, so that the thickness, which is fitted into one slit portion of the bus bar, can be doubled. Accordingly, even if the bus bar, connecting portions are not folded, it is possible to ensure a sufficient thickness for the bus bar connecting portions which are fitted into the slit portion of the bus bar.

The tip end portion of the terminal has an L-shape, therefore, it is possible to ensure a high structural strength on the tip-end side of the terminal, although the terminal has a simple shape. Moreover, the design can be more easily manufactured for example, one of two perpendicular flat plate portions is used for the connection with the bus bar, and the other portion is used for the positioning in the connector housing.

BRIEF DESCRIPTION OF THE DRAWINGS

FIG. 1 is an exploded perspective view, with parts cut away, showing an example of a joint connector, which constitutes a first embodiment of the invention;

FIG. 3 is a plan view of a terminal in the first embodiment;

FIG. 4 is a diagram of the terminal as viewed in the direction of the arrow A in FIG. 3;

DETAILED DESCRIPTION OF THE PREFERRED EMBODIMENTS

Figure 2A:
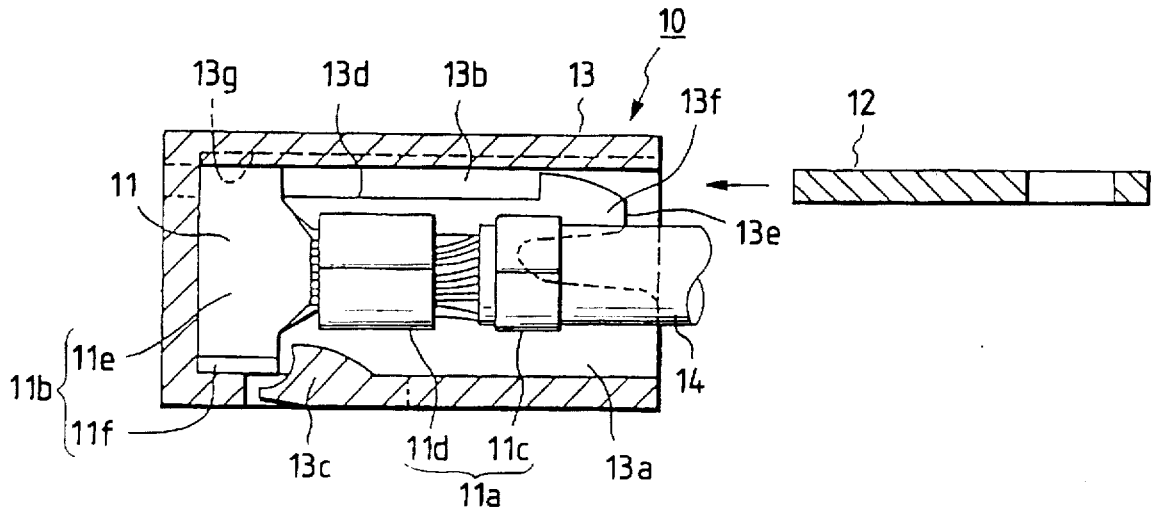
FIG. 2 (*a*) is a vertical sectional view showing a stage where the bus bar is about to be inserted into a connector housing, and FIG. 2(*b*) is a vertical sectional view showing a stage where the bus bar has been inserted into the connector housing.
Figure 2B:
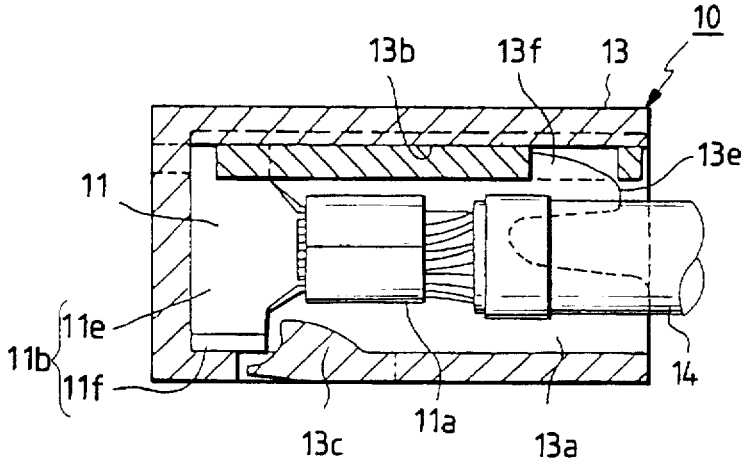
Figure 5:
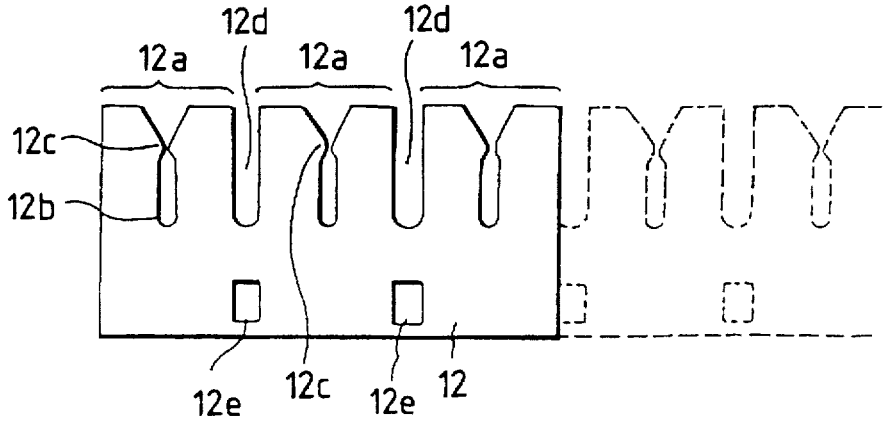
FIG. 5 is a plan view of the bus bar in the first embodiment.

Preferred embodiments of this invention will be described with reference to the accompanying drawings. FIGS. 1 through 5 illustrate an example of a joint connector, which constitutes a first embodiment of the invention. FIG. 1 is an exploded perspective view, with parts cut away, showing the joint connector according to the invention; FIG. 2 is a diagram for a description of the assembling of the joint connector; FIG. 3 is a plan view of a terminal in the joint connector; FIG. 4 is a diagram of the terminal as viewed in the direction of the arrow A in FIG. 3; and FIG. 5 is a plan view of a bus bar in the joint connector.

Referring to FIG. 1, the joint connector 10 comprises a plurality of terminals 11 each of which has a wire connecting portion 11*a* at the base, or rear, end and a bus bar connecting portion 11*b* at the front end which is electrically connected to a bus bar 12, described below; a connector housing 13 including terminal accommodating sections 13*a* for accommodating the terminals 11 in line and a bus bar accommodating section 13*b*; the bus bar 12 positioned in the bus bar accommodating section 13*b* to electrically connect the terminals 11 to one another;

and electrical wires 14 connected to the wire connecting portions 11*a* of the terminals 11.

According to the first embodiment, three terminals 11 are connected to one another through the bus bar 12. That is, with the first embodiment, one electrical line branches into two electrical lines. FIG. 2(*a*) and (*b*) are sectional side views of the joint connector. FIG. 2(*a*) shows the terminals 11 positioned in the terminal accommodating sections 13*a* and the bus bar 12 about to be inserted into the bus bar accommodating section 13*b*; and FIG. 2(*b*) shows the joint connector after the bus bar 12 has been inserted into the bus bar accommodating section.

The terminals 11 are commonly referred to as "crimping terminals", which are formed by subjecting a metal plate, which is highly conductive and elastic, to a series of plate working operations such as blanking and bending. Each of the wire connecting portions 1*a*, similarly as in the case of the conventional terminals, includes a cover fixing piece 1*c* which is crimped over the insulating cover of the wire 14 to fixedly hold it, and a connecting piece 11*d* which is also crimped so that it is connected to the exposed conductor of the wire 14.

On the other hand, each of the bus bar connecting portions 11*b*, as shown in FIGS. 3 and 4, is L-shaped in section, comprising two flat pieces 11*e* and 11*f*. That is, it has no curves which are difficult to form. The flat pieces 11*e* of the bus bar connecting portions 11*b* are engaged with terminal connecting portions, described below, of the bus bar 12, while the flat pieces 11*f* are engaged with locking protrusion 13*c* provided in the terminal accommodating sections 13*a* of the connector housing 13, as shown in FIG. 2(*a*).

The bus bar 12 is made of a metal plate having high electrical conductivity. The bus bar 12, as shown in FIGS. 1 and 5, includes a plurality of tongue-shaped terminal connecting portions 12*a* which are arranged like the teeth of a comb in correspondence to the terminals 11 arranged side by side in the connector housing 13. Each of the terminal connecting portions 12*a* has a centrally located slit 12*b*, as viewed in the direction of width (i.e., in the right-to-left direction in FIG. 5), into which the corresponding flat piece 11*e* of the respective bus bar connecting portion 11*b* is fixedly inserted. To ensure that the flat pieces 11*e* of the terminals are smoothly engaged with the slits 12*b* of the bus bar 12, each of the slits 12*b* has a wide inlet. Furthermore, in order to electrically connect the flat piece 11*e* to the terminal connecting portion 12*a* with high reliability, each of the slits 12*b* is made narrower near the inlet as indicated at 12*c*.

A slit 12*d* is formed between adjacent terminal connecting portions 12*a*. The slits 12*d* thus formed are smoothly engaged with partition walls 13*d* formed in the connector housing 13, respectively. Furthermore, in the bus bar 12, engaging holes 12*e* are formed on the elongations of the slits 12*d*, respectively, so that, when the bus bar 12 is inserted to a predetermined position in the bus bar accommodating section, the slits 12*e* are engaged with locking protrusions, described below, formed on the connector housing 13, to prevent the bus bar from becoming disengaged.

In the first embodiment, the bus bar 12 is formed as follows. As shown in FIG. 5, a belt-shaped plate is formed which has a number of terminal connection portions 12*a* arranged side by side, and it is cut according to the number of terminals of a given joint connector to obtain the desired bus bar, the remaining portion of the belt-shaped plate being indicated by the dotted line.

The connector housing 13 is formed by molding synthetic resin which is high in insulation resistance. As shown in FIG. 2, the connector housing 13 is in the form of a rectangular box which includes the terminal accommodating sections 13*a* arranged side by side in which the terminals 11 are arranged, and the bus bar accommodating section 13*b* located above the terminal accommodating sections 13*a*. Both the terminal accommodating sections 13*a* and the bus bar accommodating section 13*b* have openings provided in one end face of the connector housing (in the right end face in FIG. 2). The terminals 11 and the bus bar 12 are inserted into the respective accommodating sections through those openings.

The terminal accommodating sections 13*a* have the aforementioned elastic locking protrusions 13*c* which, when the terminals 1 have been inserted thereinto as required, abut against the rear surface of the flat pieces 11*f* of the terminals 11, to prevent the terminals 1 from being withdrawn from the housing inadvertently.

The terminal accommodating sections 13*a* are isolated from one another by partition walls 13*d*. Each of the partition walls 13*d* is designed as shown in FIGS. 1 and 2(*a*) and (*b*). That is, the upper end portion, defining the bus bar accommodating section 13*b*, is separated from the upper wall of the connector housing 13, and the outer end portion near the opening of the connector housing has a cut-out at the middle, so that it has an arm 13*e* which is elastically vertically movable. The arms 13*e* of the partition walls 13*d* have locking protrusions 13*f* which extend upwardly so as to engage the engaging holes 12*e* of the bus bar when it has been completely inserted, to prevent the terminals 11 from disengaging from the connector housing.

Guide grooves 13*g* are formed in the inner surface of the upper wall of the connector housing 13 with which the flat pieces 11*e* of the terminals 11 are slidably engaged. In inserting the terminals 11 into the terminal accommodating sections 13*a*, the guide grooves 13*g* hold the terminals 11 stable, so that, when the bus bar 12 is inserted into the bus bar accommodating section, the terminals 11 are positively engaged with the bus bar 12.

In the joint connector of the first embodiment, the flat pieces 11*e* of the terminals 11 are fixedly engaged with the slits 12*d* of the bus bar 12, so that the terminals 11 are positively electrically connected to the bus bar 12. Hence, the end portions of the terminals 11 are considerably simple in configuration. Furthermore, as compared to the conventional terminals discussed above, the terminals 11 are relatively short. Accordingly, the connector housing 13 accommodating the terminals 11 is likewise smaller in length so that the space occupied by the joint connector is reduced as much.

Finally, since the terminals have a much simpler configuration, the cost of manufacturing the joint connector is significantly decreased with an increase in yield.

As noted above, the bus bar connecting portion 11*b* of each of the terminals 11 is L-shaped in cross-section thereby having a simple configuration. Despite the simple configuration, the front end portion of the terminal 11 has high a mechanical strength, and, on the other hand, increases the degree of freedom in design—one of the flat pieces of the bus bar connecting portion 11*b*, forming right angles, is used to connect the terminal to the bus bar 12, while the other to position the terminal in the connector housing 13.

Figure 6:
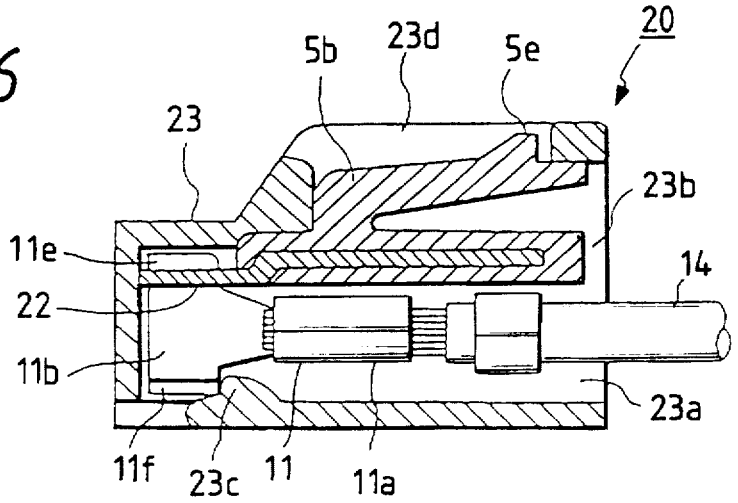
FIG. 6 is a vertical sectional view showing another example of the joint connector, which constitutes a second embodiment of the invention.
Figure 7:
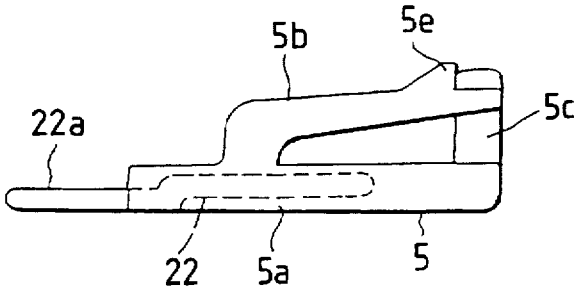
FIG. 7 is a side view showing a bus bar in the second embodiment.
Figure 8:
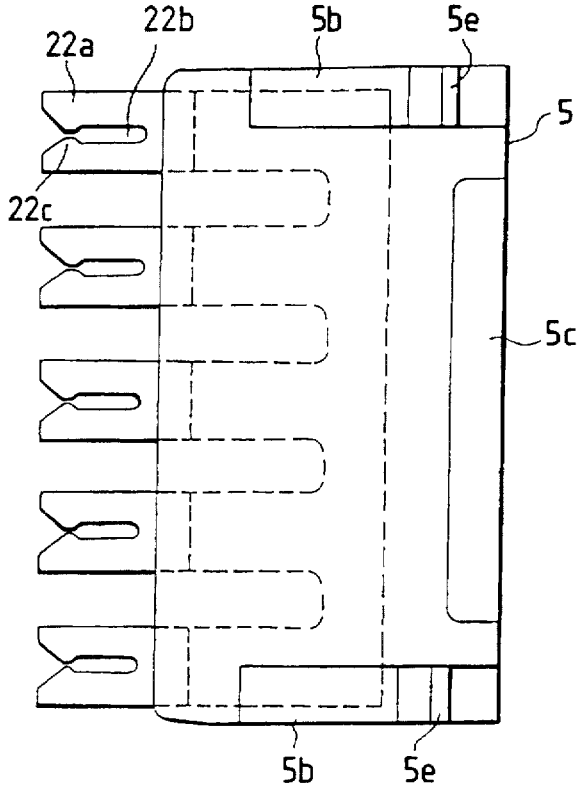
FIG. 8 is a plan view showing the bus bar in the second embodiment.

FIGS. 6 through 8 illustrate another joint connector which constitutes a second embodiment of the invention. In FIGS. 6 through 8, parts corresponding functionally to those which have been described with reference to the first embodiment, FIGS. 1 through 5, are therefore designated by the same reference numerals or characters.

According to the second embodiment, the joint connector comprises: a plurality of terminals 11 each having a wire connecting portion 11*a* at the base, or rear, end and a bus bar connecting portion 11*b* at the front end which is electrically connected to a bus bar 22; a connector housing 23 including terminal accommodating sections 23*a* for accommodating the terminals 11 side by side and a bus bar accommodating section 23*b*; the aforementioned bus bar 22 located in the bus bar accommodating section 23*b* to electrically connect the terminals 11 to one another; and electrical wires 14 connected to the wire connecting portions 11*a* of the terminals 11.

The terminals 11 and electrical wires 14 are the same as those described in the above-described first embodiment, and the manner of engaging the bus bar 22 with the terminals 11 is also the same. In addition, the engagement of the bus bar 22 with the connector housing 23 is the same in many respects to that of the conventional joint connector shown in FIGS. 19 through 22.

Hence, only the differences between the first and second embodiments will be described.

According to the second embodiment, the bus bar 22 is made of a metal plate high in electrical conductivity. The bus bar 22, as shown in FIGS. 7 and 8, includes a plurality of tongue-shaped terminal connecting portions 22*a* which are arranged like the teeth of a comb in correspondence to the terminals 11 positioned side by side in the connector housing 23. Each of the terminal connecting portions 22*a* has a centrally disposed slit 12*b* as viewed in the direction of width (in a vertical direction in FIG. 8) into which the flat piece 11*e* of the associated bus bar connecting portion 11*b* is inserted. The entrance portion of each slit is relatively wide so that when the bus bar 22 is inserted into the bus bar accommodating section 23*b* of the connector housing 23, the flat pieces 11*e* are smoothly received in the slits 22*b* of the bus bar 22. Furthermore, in order to electrically connect the flat piece 11*e* to the terminal connecting portion 12*a* with high reliability, each of the slits 22*b* is made narrower near the inlet as indicated at 22*c*.

The base end portion of the bus bar 22 (where the tongue-shaped terminal connecting portions 22*a* are coupled to one another), as shown in FIGS. 7 and 8, is buried in a spacer 5 made of synthetic resin high in insulation. The spacer 5 serves to fix the bus bar 22 in the bus bar accommodating section 23*b* when the bus bar 22 has been inserted to a predetermined position (where the terminal connecting portions 2*a* are engaged with the flat pieces 11*e* of the terminals 11). The spacer 5 has the same structure as that shown in FIGS. 21 and 22 (the conventional joint connector), and therefore its essential parts are designated by the same reference numerals or characters.

The connector housing 23 is in the form of a rectangular box which includes the terminal accommodating sections 23*a* arranged side by side in which the terminals 11 are inserted, and the bus bar accommodating section 23*b* above the terminal accommodating sections 13*a*. Both the terminal accommodating sections 23*a* and the bus bar accommodating section 23*b* have openings in one end face of the connector housing (in the right end face in FIG. 6). The terminals 11 and the bus bar 22 are inserted into the respective accommodating sections through those openings.

The terminal accommodating sections 13*a* have elastic locking protrusions 23*c* which, when the terminals 1 have been inserted thereinto as required, abut against the rear surface of the flat pieces 11*f* of the terminals 11, to prevent the terminals 1 from inadvertently disengaging.

Engaging holes 23*d* are formed in the upper wall of the bus bar accommodating section 23*b*. When the bus bar 22 has been inserted into the bus bar accommodating section 23*b* to the predetermined position, the engaging holes 23*d* are engaged by the locking protrusions 5*e* of the spacer 5, to prevent the bus bar 22 from being inadvertently withdrawn from the connector housing 23.

As with the first embodiment, according to the second embodiment, the flat pieces of the terminals 11 are fixedly engaged with the slits of the bus bar 22, so that the terminals 11 are electrically connected to the bus bar 22. Further, the terminals 11 are small in length resulting in a more compact joint connector. Furthermore, since the terminals 11 have a simplified configuration, manufacturing costs of the joint connector are decreased and the yield is increased.

Figure 9:
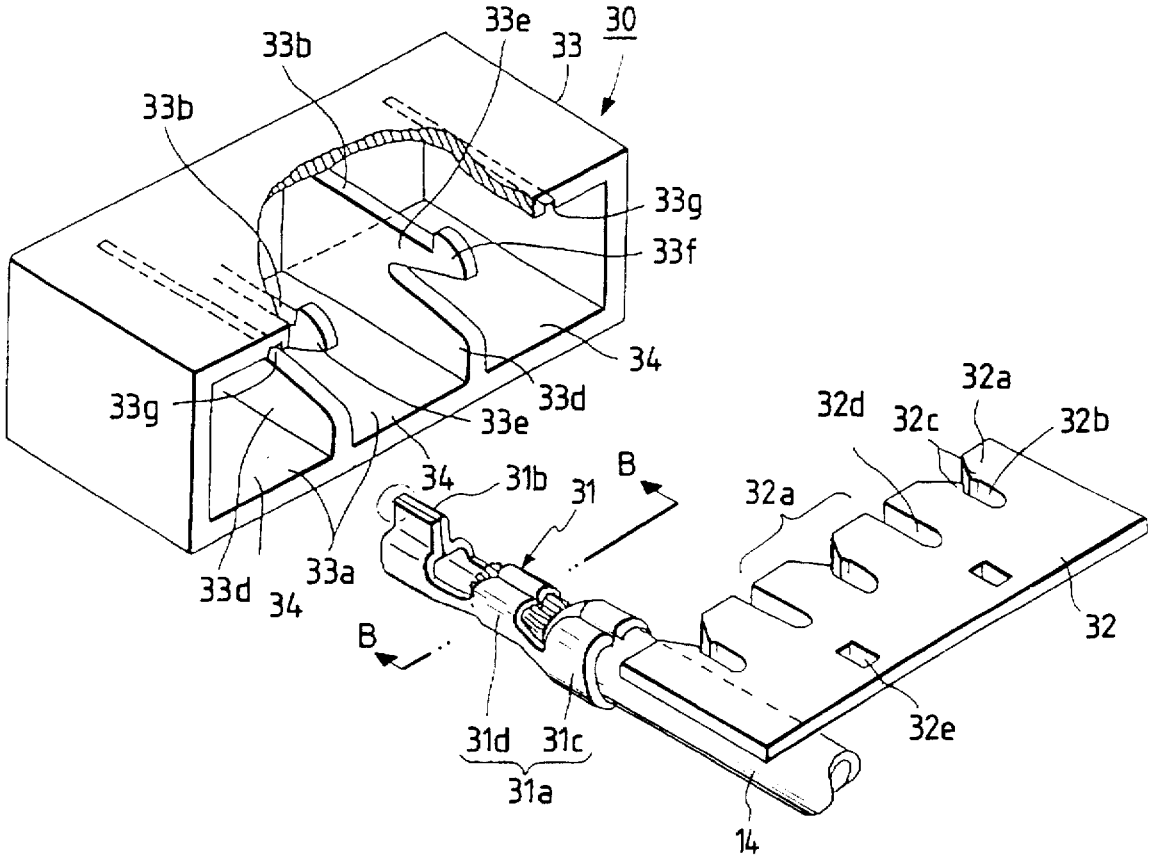
FIG. 9 is an exploded perspective view, with parts cut away, showing another example of the joint connector, which constitutes a third embodiment of the invention.
Figure 10:
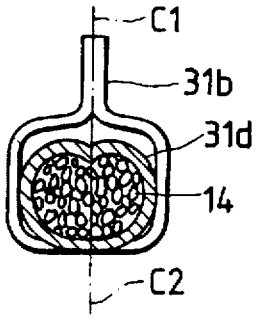
FIG. 10 is a sectional diagram taken along line B—B in FIG. 9.
Figure 11:
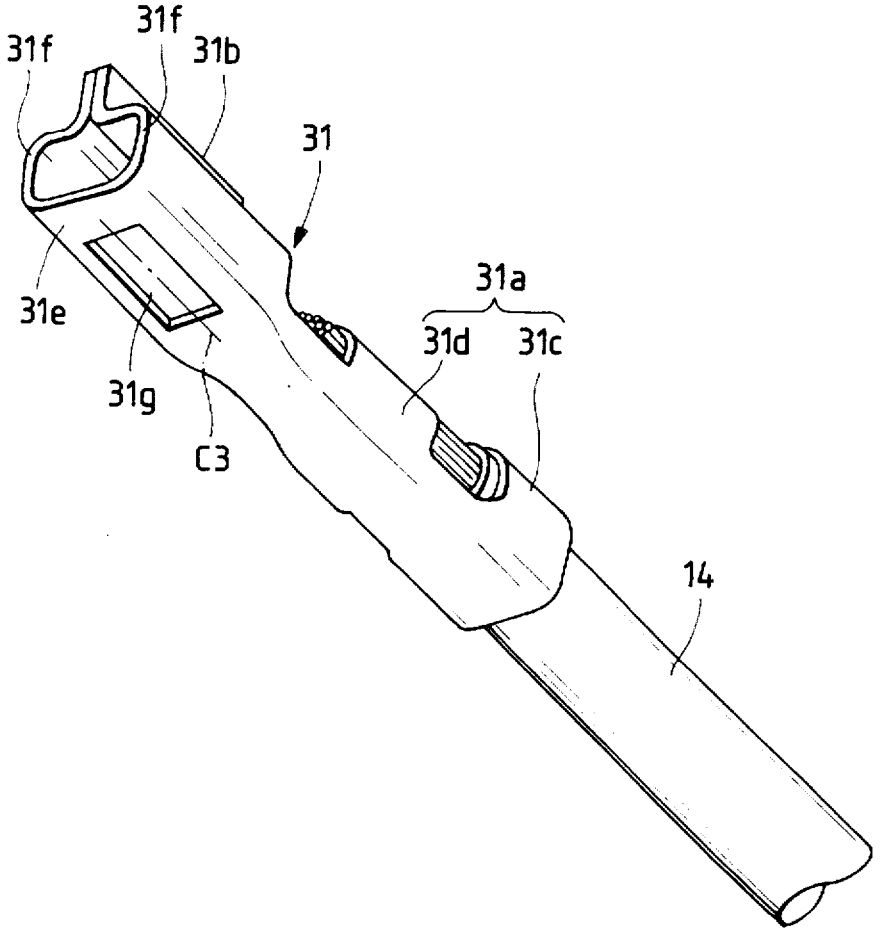
FIG. 11 is a perspective diagram of the terminal as viewed from below.

FIGS. 9 through 12 show another example of the joint connector, which constitutes a third embodiment of the invention. FIG. 9 is an exploded perspective view, with parts cut away, showing the joint connector; FIG. 10 is a sectional view taking along line B—B in FIG. 9, showing a terminal in the joint connector; FIG. 11 is a perspective diagram of the terminal as viewed from below; and FIGS. 12(*a*) and (*b*) are diagrams for a description of the assembling of the joint connector.

The joint connector 30, the third embodiment, is obtained by improving the structure of the bus bar connecting portion 11*b* of each of the terminals 11 in the first embodiment. That is, part of the bus bar 12 and the structure of the connector housing 13 of the first embodiment are changed.

The joint connector 30 of the third embodiment of the invention, comprises: a plurality of terminals 31 each of which has a wire connecting portion 31*a* at the base end and a bus bar connecting portion 31*b* at the front end which is electrically connected to a bus bar 32; a connector housing 33 including terminal accommodating sections 33*a* for accommodating the terminals 31 side by side and a bus bar accommodating section 33*b*; the bus bar 32 set in the bus bar accommodating section 33*b* to electrically connect the terminals 31 to one another; and electrical wires 14 connected to the wire connecting portions 31*a* of the terminals 31. However, the third embodiment is substantially the same as the first embodiment except for the design of the front end portions of the terminals 31 which include the bus bar connecting portions 31*b*.

The terminals 31 are formed by subjecting a metal plate which is high in electrical conductivity and elasticity to a series of plate working operations such as blanking and bending. As in the case of the terminals in the first embodiment, each of the wire connecting portions 31*a* includes a cover fixing piece 31*c* which is crimped to fixedly hold the insulating cover of the wire 14, and a connecting piece 31*d* which is also crimped so that it is connected to the exposed conductor of the wire 14.

Figure 12A:
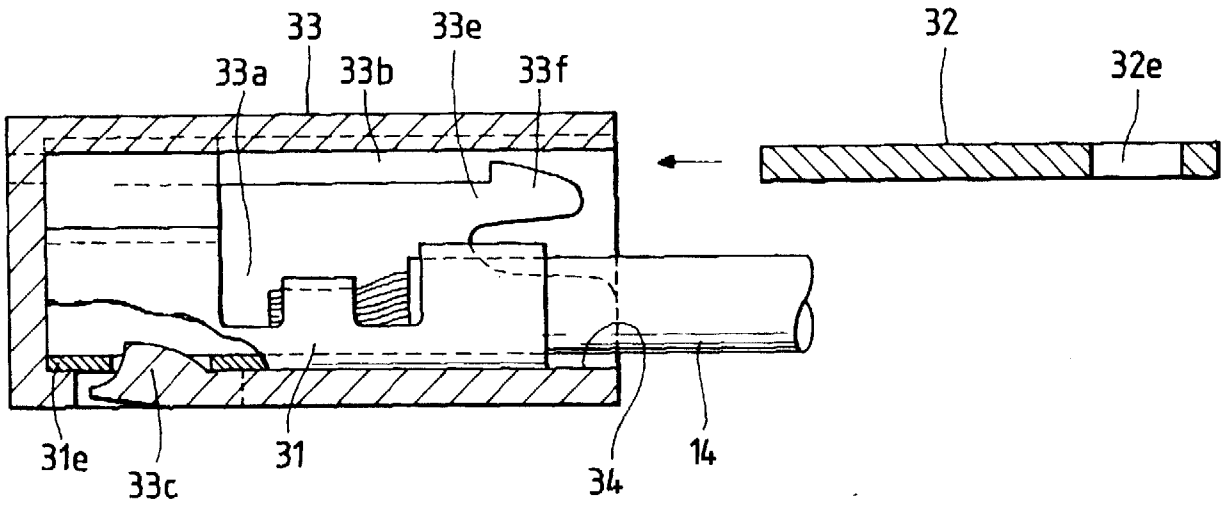
FIG. 12(*a*) is a vertical sectional view showing a stage in which the bus bar is about to be inserted into a connector housing, and FIG. 12(*b*) is a vertical sectional view showing a stage in which the bus bar has been inserted into the connector housing, thus accomplishing the assembling work of the joint connector.
Figure 12B:
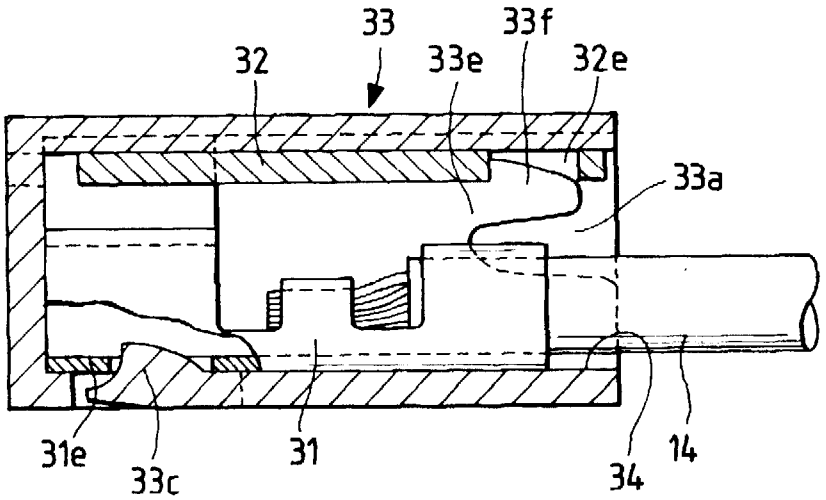

As shown in FIGS. 11 and 12, the front end portion of each of the terminals 31 comprises: a flat-plate-shaped base plate portion 31*e* which is inserted into the respective terminal accommodating section 33*a* of the connector housing 33 while being slid along the bottom wall 34 of the terminal accommodating section 33*a*; and the aforementioned bus bar connecting portion 31*b*. The bus bar connecting portion 31*b* is of a lamination structure. More specifically, the bus bar connecting portion 31 is formed as follows. A pair of plate pieces 31*f* extending from both sides of the base plate portion 31*e* are suitably folded and joined to each other to form a flat plate portion relatively large in thickness which is engaged with a slit 32*b* formed in the respective terminal connecting portion 32*a* of the bus bar 32. In addition, the bus bar connecting portion 31*b* is so positioned that, as shown in FIG. 10, its middle C1 in the direction of wall thickness thereof is in alignment with the central axis C2 of the wire 14 fixedly held by the wire connecting portion 31*a*.

As shown in FIGS. 11 and 12(*a*) and (*b*), locking holes 31*g* are formed in the base plate portions 31*e* of the terminals 31, respectively, so that, when the terminals 31 have been inserted into the terminal accommodating sections 33*a* of the connector housing 33 as required, the locking holes 3l*e* are engaged by engaging protrusions 33*c* which are formed on the bottoms 34 of the terminal accommodating sections 33*a*, thus preventing the terminals from withdrawing from the connector housing. More specifically, the central lines C3 of the locking holes 31*g* are in alignment with the central axes of the wires 14 secured to the base end portions of the terminals 31, respectively. That is, each of the terminals 31 is symmetrical in structure with respect to its axis.

The bus bar 32 is made of a metal plate high in electrical conductivity. Similar to the first embodiment, the bus bar includes a plurality of tongue-shaped terminal connecting portions 32*a* which are arranged like the teeth of a comb in correspondence to the terminals 31 set side by side in the connector housing 33. The terminal connecting portions 32*a* have centrally located slits 32*b* as viewed in the direction of width, into which the flat-plate-shaped bus bar connecting portion 31*b* are fixedly inserted, respectively. To ensure that the bus bar connecting portions 31*b* of the terminals 31 are smoothly engaged with the slits 32*b* of the bus bar 22, each of the slits 32*b* has a wide inlet opening. Furthermore, in order to electrically connect the bus bar connecting portions 31*b* of the terminals 31 to the terminal connecting portions 32*a* of the bus bar 32 with high reliability, each of the slits 32*b* is made narrower near the inlet as indicated at 32*c*. As was described above, the bus bar connecting portions 31*b* of the terminals 31 are of a lamination structure. Hence, the bus bar connecting portions 31*b* are larger in thickness than those in the first embodiment, and accordingly the slits 32*b* are also wider than those in the first embodiment.

A slit 32*d* is formed between adjacent terminal connecting portions 32*a* of the bus bar 32. The slits 32*d* thus formed are smoothly engaged with partition walls 33*d* formed in the connector housing 33, respectively. Furthermore, engaging holes 32*e* are formed in the bus bar 32 on the elongations of the slits 12*d*, respectively, so that, when the bus bar 32 has been inserted into the bus bar accommodating section as required, the slits 32*e* are engaged by locking protrusions formed on the connector housing 33, to prevent the bus bar from disengaging from the connector housing 33.

The connector housing 33 is formed by molding synthetic resin high in insulation. As shown in FIGS. 9 and 12, the connector housing 13 is in the form of a rectangular box which includes the terminal accommodating sections 33*a* arranged side by side in which the terminals 31 are inserted , and the bus bar accommodating section 33*b* above the terminal accommodating sections 33*a*. Both the terminal accommodating sections 33*a* and the bus bar accommodating section 33*b* have openings in one end face of the connector housing (in the right end face in FIG. 12). The terminals 31 and the bus bar 32 are inserted into the respective accommodating sections through those openings.

The terminal accommodating sections 33*a* have elastic locking protrusions 33*c* which, when the terminals 31 have been inserted thereinto as required, extend into the locking holes 31*g* formed in the ba se plate portions 31*e* of the terminals 31, to prevent the terminals 31 from with drawing. Each of the elastic locking protrusions 33*c* is formed along the central line of the bottom of the respective terminal accommodating section 33*a* in correspondence to the position of the respective locking hole 31.

The terminal accommodating sections 33*a* are isolated from one another by partition walls 33*d*. Each of the partition walls 33*d* is designed as shown in FIGS. 9 and 12. That is, the upper end portion, defining the bus bar accommodating section 33*b*, is separated from the upper wall of the connector housing 33, and the outer end portion near the opening of the connector housing has a cut-out at the middle, so that it has an arm 33*e* which is elastically movable in a vertical direction. The arms 13*e* of the partition walls 13*d* have locking protrusions 33*f* which extend upwardly. The locking protrusions 33*f* function as follows. When the bus bar 32 is inserted into the bus bar accommodating section 33 to the predetermined position, the locking protrusions 33*f* engage the engaging holes 32*e* formed in the bus bar 32, to prevent the terminals 31 from withdrawing from the connector housing.

Guide grooves 33*g* are formed in the inner surface of the upper wall of the connector housing 33 with which the front ends of the bus bar connecting portions 31*b* of the terminals 31 are slidably engaged. That is, the grooves 33*g* extend along the central axes of the terminal accommodating sections 33*a* in the front-to-rear direction of the connector housing 33. In inserting the terminals 31 into the terminal accommodating sections 33*a*, the guide grooves 33*g* hold the terminals 31 stable, so that, when the bus bar 32 is inserted, the terminals 31 are positively engaged with the latter 32.

In the joint connector of the third embodiment of the invention, the flat-plate-shaped bus bar connecting portions 31*b* of the terminals 31 are fixedly engaged with the slits 32*d* of the bus bar 12, so that the terminals 31 are positively electrically connected to the bus bar 32. Hence, similarly as in the cases of the first and second embodiments, the terminals 31 are smaller in length than those in the conventional joint connector, and accordingly the connector housing 33 is also smaller in length; that is, the space occupied by the joint connector is reduced. Furthermore, the terminals are simplified in configuration, which contributes to a reduction in the manufacturing costs and improvement in the manufacturing yield.

In the third embodiment, when compared with the first and second embodiments, the end portions of the terminals 31 are high in mechanical strength and the bus bar 31 can be formed with ease. In addition, in the connector housing 33, no useless spaces is provided around the terminals 31. That is, the terminals 31 can be inserted into the connector housing 33 with high density. Those effects will be described below in more detail.

Figure 13:
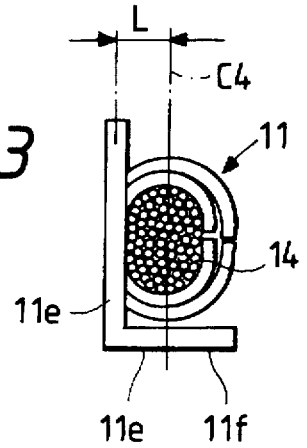
FIGS. 13 through 15 are explanatory diagrams for a complementary description of the first embodiment of the invention.
Figure 14:
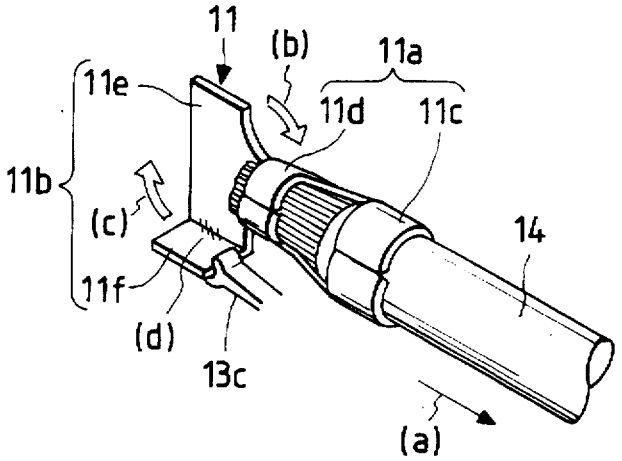

In the case of the first embodiment, the width of the slits 12*b* formed in the bus bar 12 corresponds to the thickness of the metal plate used to form the terminals 11. The thickness of the metal plate is considerably smaller when compared with those that are utilized for ordinary blanking work. Hence, the slits 12*b* are of high precise, which makes it difficult to reduce the manufacturing cost of the joint connector. Furthermore, in the case of the first embodiment, the position of the flat piece lie engaged with the slit 12*b* of the bus bar 12, as shown in FIG. 13, is shifted as much as a distance L from the central axis C4 of the wire 14 held by the terminal 11. On the other hand, as shown in FIG. 14, the other flat piece 11*f* which is extended from the aforementioned flat piece 11*e* and bent in the direction of width of the terminal accommodating section 13*a* is engaged with the elastic locking protrusion 13*c*. Hence, when a tensile force acts on the wire 14 as indicated by the arrow (a) in FIG. 14, torsional forces act on the front end portion of the terminal 11 as indicated by the arrows (b) and (c). As a result, the front end portion of the terminal 11 may be deformed, or at worst it may be broken by the concentration of stress on the bending line between the two plate pieces 11*e* and 11*f*.

Figure 15:
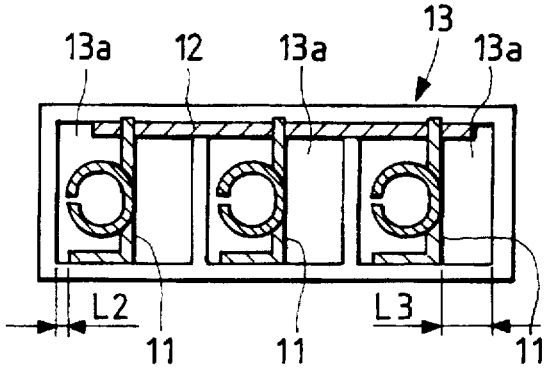

In addition, the first embodiment may suffer from the following difficulty. As shown in FIG. 15, the gaps L2 and L3 formed on both sides of each of the terminals 11 in the terminal accommodating sections 13*a* are not uniform, resulting in useless spaces in the connector housing 13. That is, the density of the terminals in the connector housing is low.

On the other hand, the third embodiment is free from the above-described difficulties. That is, the bus bar connection portion 31*b* forming the front end portion of each of the terminals 31, is of a laminated structure formed by uniting two plate pieces 31*f* on top of each other. Hence, the thickness of the bus bar connecting portion 31*b* is twice as thick as that of the plate pieces 31*f*, and accordingly the width of the slit 32*b* is also twice as wide. This means that the slits 32*b* can be formed in the bus bar 32 with ease.

Figure 16:
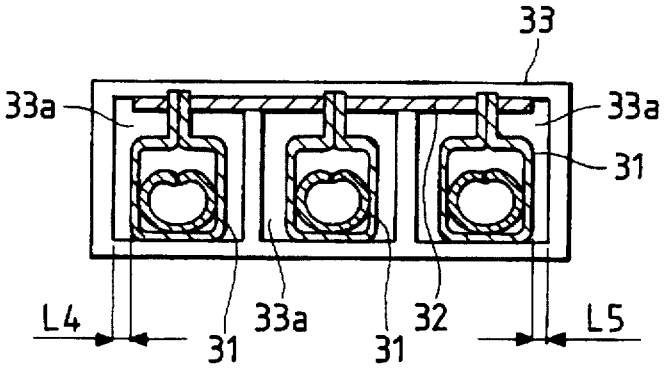
FIG. 16 is an explanatory diagram for the purpose of describing the effect of the third embodiment of the invention.

Furthermore, in the case of the third embodiment, as shown in FIG. 16, in each of the terminal accommodating sections 33*a*, the terminal 31 can be positioned symmetrically with respect to the central axis of the terminal accommodating section 33*a* (i.e., the position of the slit 32*b* of the bus bar 32). As is apparent from comparison of the third embodiment with the first embodiment in which the end portion of each of the terminals is L-shaped, the gaps L4 and L5 provided on both sides of the terminal 31 in each of the terminal accommodating section 33*a* are uniform. Hence, the connector housing 33 may be so designed that there is no unused space; that is, the terminals can be either arranged with a higher density, or the connector housing can be more compact.

Figure 17:
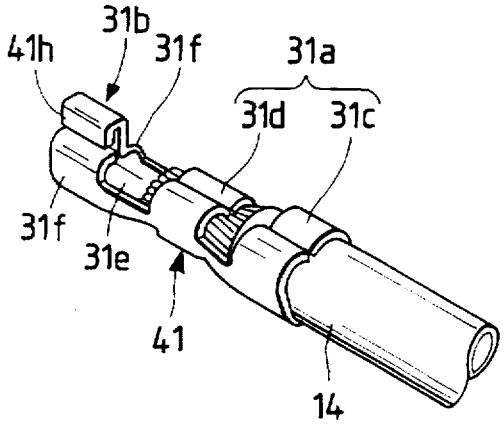
FIG. 17 is a perspective view showing a terminal in another example of the joint connector, which constitutes a fourth embodiment of the invention.

In addition, in the third embodiment, the locking position of the terminal 31 engaged with the elastic locking protrusion 33*c* provided on the connector housing 33, and the flat-plate-shaped bus bar connecting portion 31*b* forming the front end portion of the terminal 31, and the slit 32*b* of the bus bar 32, and the wire 14 fixedly held by the terminal 31 are all on the same central line. Hence, even when a tensile force acts on the wire 14 connected to the terminal 31 to pull the latter 31 out of the connector housing, a minimal torsional force is applied to the front end portion of the terminal 31. That is, the end portions of the terminals 31 retain their high mechanical strength, and experience minimal deformation as a result of such a tensile force FIG. 17 shows a terminal 41 in another example of the joint connector, which constitutes a fourth embodiment of the invention. The terminal 41 is obtained by improving a part of the terminal 31 in the third embodiment. The remaining components are identical in structure to those in the third embodiment; therefore, in FIG. 17, parts corresponding functionally to those which have been described with reference to the third embodiment are designated by the same reference numerals or characters.

The front end portion of each of the terminals 41, similarly as in the case of the third embodiment, comprises a flat-plate-shaped base plate portion 31*e*; and a bus bar connecting portion 31*b* of a laminated structure which is formed by joining a pair of plate pieces 31*f* extending from both sides of the base plate portion 31*e*, thus serving as a flat plate portion relatively large in thickness which is engaged with the a slit formed in the respective terminal connecting portion of the bus bar. The bus bar connecting portion 31*b* is so positioned that the middle of the bus bar connecting portion 31*b* in the direction of wall thickness thereof is in alignment with the central axis of the electrical wire fixedly held by the wire connecting portion of the terminal.

It should be noted that the bus bar connecting portion 31 is of a three-layer structure. In the terminal 41, a folding plate 41*h* extends from one of the right and left plate pieces 31*f* and is folded over the other plate piece. For the purpose of simplification, it is assumed that the folding plate 41*h* extends from the right plate piece 31*f*. With the right and left plate pieces 31*f* are joined on top of each other, the folding plate 41*h* is folded along the upper edge of the left plate piece 31*f* so that it covers the latter; that is, the right and left plate pieces 31*f* and the folding plate piece 41*h* form a three-layer structure. Hence, the bus bar connecting portions 31*b* of the terminals 31 are larger in thickness and higher in mechanical strength than those in the third embodiment.

Figure 18:
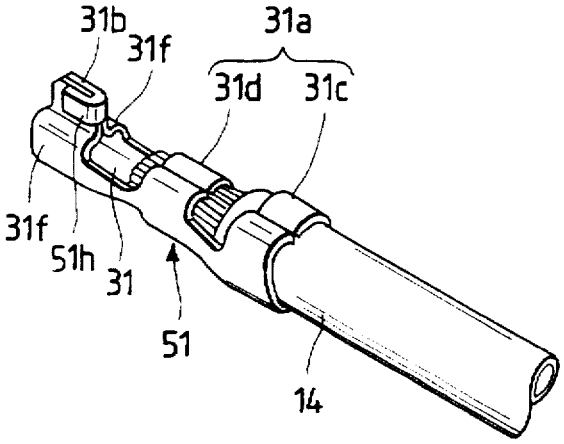
FIG. 18 is a perspective view showing a terminal in another example of the joint connector, which constitutes a fifth embodiment of the invention.
Figure 19:
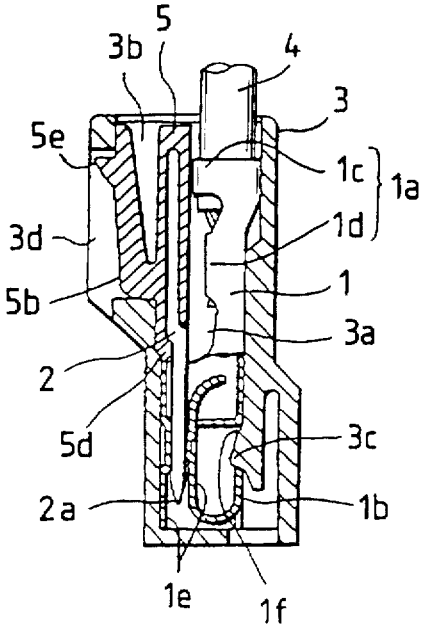
FIG. 19 PRIOR ART
FIG. 19 is a sectional view showing a conventional joint connector.
Figure 20:
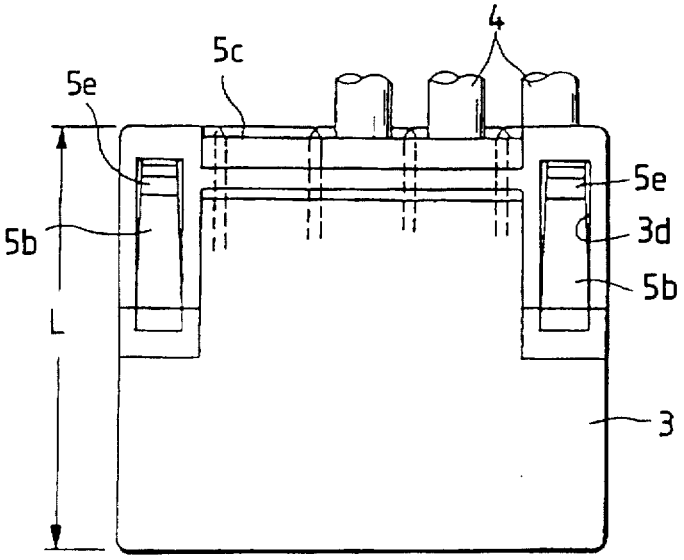
FIG. 20 PRIOR ART
FIG. 20 is a plan view of the conventional joint connector.
Figure 21:
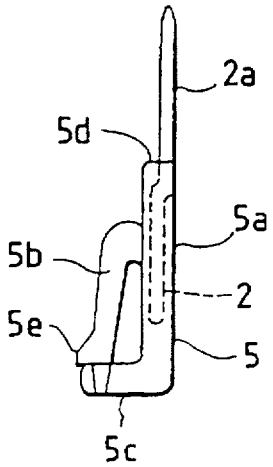
FIG. 21 PRIOR ART
FIG. 21 is a side view showing a bus bar in the conventional joint connector.
Figure 22:
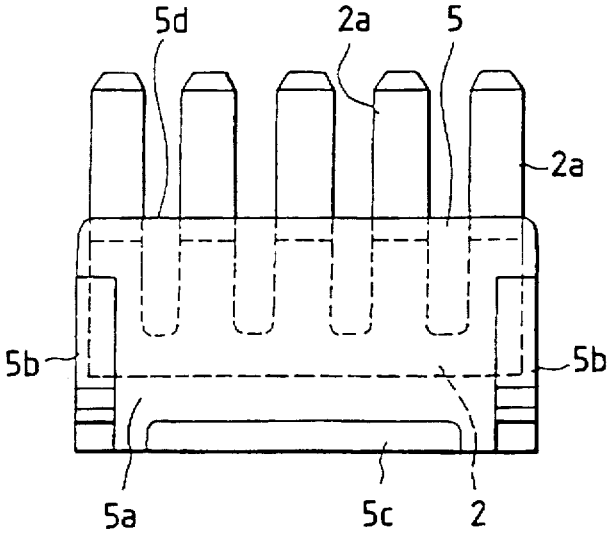
FIG. 22 PRIOR ART
FIG. 22 is a plan view showing the bus bar in the conventional joint connector.

FIG. 18 shows a terminal 51 in another example of the joint connection, which constitutes a fifth embodiment of the invention.

Similarly as in the case of the above-described fourth embodiment, the bus bar connecting portion 31*b* of the terminal is of a three-layer structure. That is, with a pair of right and left plate pieces 31*f* joined on top of each other, a folding plate 51*h* extending from one of the pair of plate pieces 31*f* is folded over the other plate piece 31*f*. However, it should be noted that the folding plate 51*h* extends from the edge, on the side of the wire connecting portion 31*a*, of the one plate piece 31*f* towards the wire connecting portion 31*a*. The folding plate 51*h* is folded along the edge, on the side of the wire connecting portion 31*a*, of the other plate piece 31*f* so that it covers the latter 31*f*.

The fifth embodiment is equal in function and in effect to the fourth embodiment.

In the above-described embodiments of the invention, the bus bar connecting portion of each of the terminals is simply planar, and each of the terminal connecting portions of the bus bar has a slit with which the bus bar connecting portion is engaged. However, the slit may be formed in the bus bar connecting portion, or it may be formed both in the bus bar connecting portion and in the terminal connecting portion.

Furthermore, in the above-described embodiments, the locking protrusions are provided as a means for fixedly positioning the terminals and the bus bars in place in the connector housing; however, the invention is not limited thereto or thereby. That is, the locking protrusions may be replaced with any other suitable means.

As is apparent from the above description, in the joint connector of the invention, the flat pieces of the terminals are fixedly engaged with the slits of the bus bar so that the terminals are electrically connected to the bus bar. Hence, the front end portions of the terminals may be considerably simplified in configuration, and the terminals are smaller in length than the terminals in the conventional joint connector which has an intricately bent the contact piece at the front end accordingly the connector housing is also smaller by virtue of the space occupied by the joint connector being correspondingly reduced.

Furthermore, the simplification in configuration of the terminals contributes to a reduction in the manufacturing cost and improvement in the manufacturing yield.

In the joint connector, the bus bar connecting portions of the terminals are L-shaped having two plate pieces forming right angles with each other. Hence, the front end portions of the terminals exhibit a high in mechanical strength, even though they have a relatively simple configuration. One of the plate pieces is used to engage the terminal with the bus bar, while the other is used to position the terminal in the connector housing. That is, the bus bar connecting portions thus shaped contribute to increase the degree of freedom in design.

In addition, in the joint connector, the front end portion of each of the terminal includes: the flat-plate-shaped base plate portion which is inserted into the respective terminal accommodating section of the connector housing while being slid on the bottom of the terminal accommodating section; and the bus bar connecting portion having a laminated structure which is formed by joining the plate pieces extending from both sides of the base plate portion, thus serving as the flat plate portion relatively large in thickness which is engaged with the slit formed in the respective terminal connecting portion of the bus bar. The resultant flat-plate-shaped bus bar connecting portion is larger in thickness than the plate material used to form the terminal. Hence, the width of the slits formed in the bus bar, which are engaged with the bus bar connecting portions of the terminal, can be increased to a value which is readily obtainable during blanking, thereby contributing to a reduction in the manufacturing cost of the joint connector.

Moreover, in the joint connector, the bus bar connecting portion is so positioned that the middle of the bus bar connecting portion in the direction of wall thickness thereof is in alignment with the central axis of the electrical wire fixedly held by the wire connecting portion. Hence, in each of the terminal accommodating sections, the terminal can be positioned symmetrically with respect to the central axis of the terminal accommodating section (i.e., the position of the slit of the bus bar). In this case, unlike the case where the end portion of each of the terminals is L-shaped, the gaps provided on both sides of the terminal in each of the terminal accommodating sections are uniform, and the connector housing is correspondingly improved in configuration.

In addition, in the joint connector, the base plate portion of the front end portion of each of the terminals has a locking hole which, when the terminal has been inserted into the respective terminal accommodating section in the connector housing to the predetermined position, is engaged by a locking protrusion which is formed on the bottom of the terminal accommodating section, in such a manner that the central line of the locking hole is in alignment with the central axis of the electrical wire fixedly connected to the terminal connecting portion of the terminal. In this case, the flat-plate-shaped bus bar connecting portion of the terminal, the slit of the bus bar, and the wire fixedly connected to the base end portion of the terminal are in alignment with one another. Therefore, even when a tensile force acts on the wire connected to the terminal to pull the latter out of the connector housing, a torsional force is scarcely applied to the front end portion of the terminal. That is, -the end portions of the terminals are maintained high in mechanical strength, and are scarcely deformed by such a tensile force.

Figure 23:
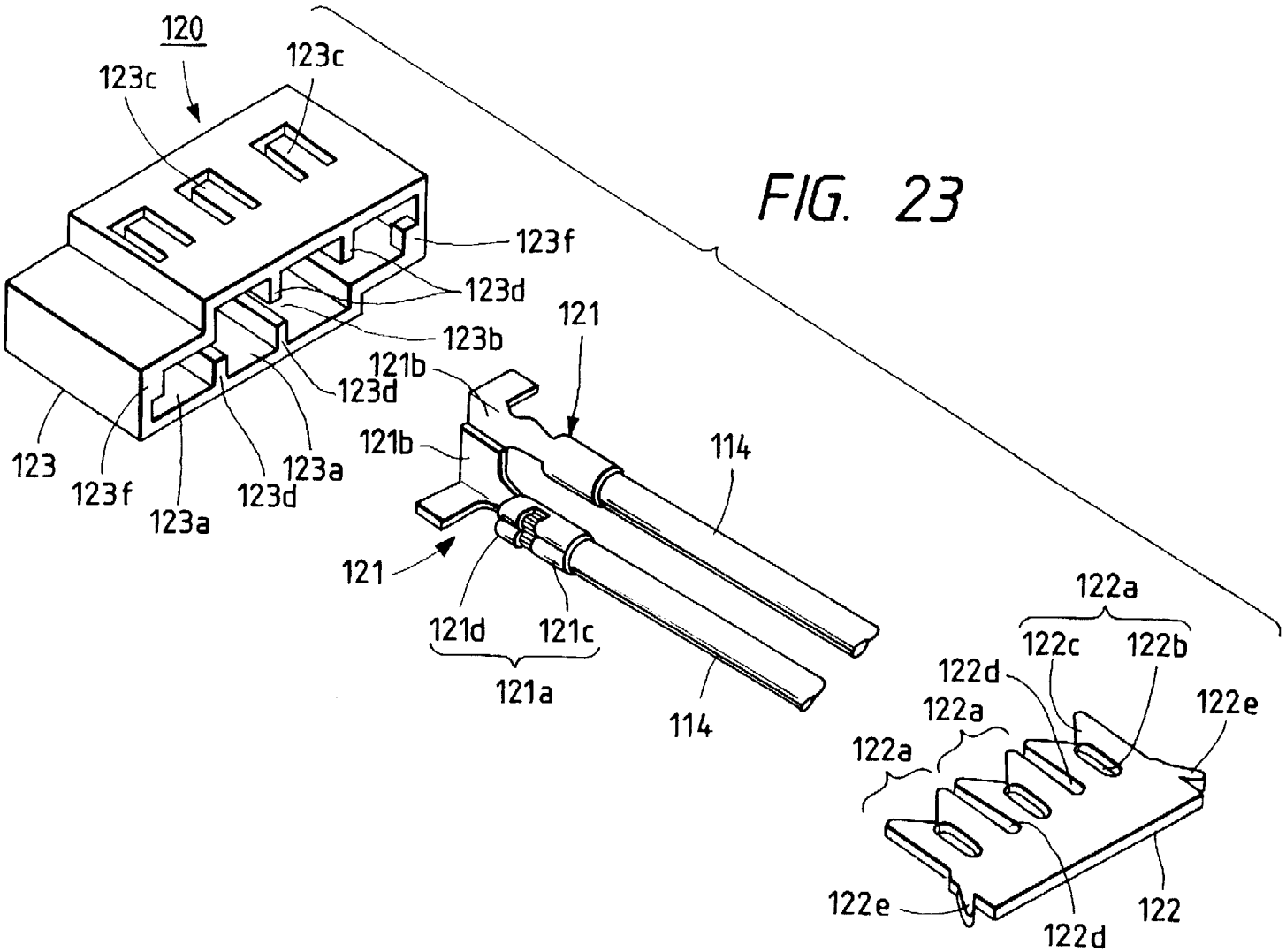
FIG. 23 is an exploded perspective view of a joint connector which is an embodiment of the invention.
Figure 24:
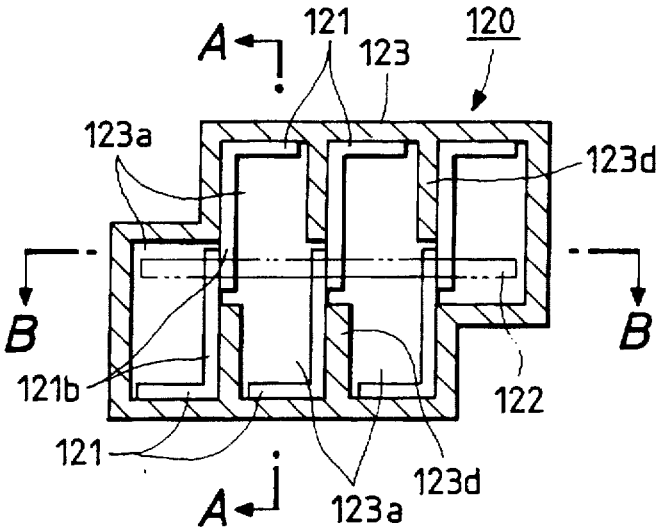
FIG. 24 is a front view showing the assembly of the joint connector of the embodiment of the invention.
Figure 25:
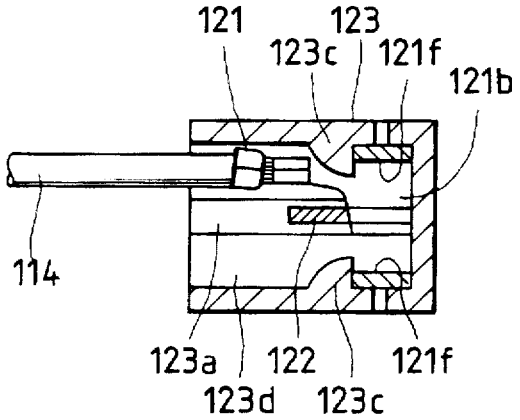
FIGS. 25 is a section view taken along a line A—A in FIG. 24.
Figure 26:
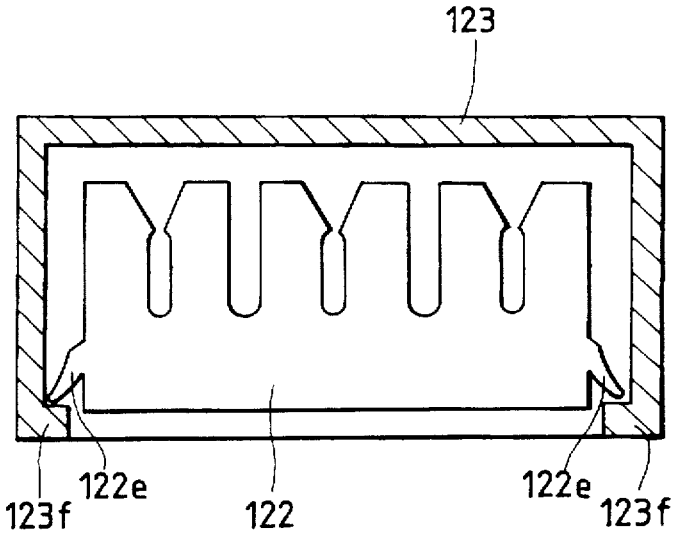
FIG. 26 is a section view taken along a line B—B in FIG. 24.

FIGS. 23 to 26 show a sixth embodiment of the joint connector according to the invention. FIG. 23 is an exploded perspective view of the connector before the assembly, FIG. 24 is a front view of the assembly, FIG. 25 is a section view taken along a line A—A in FIG. 24, and FIG. 26 is a section view taken along a line B—B in FIG. 24.

The joint connector 120 of the embodiment comprises: a plurality of terminals (electric terminals) 121 in each of which an electric wire connecting portion 121*a* is disposed on a basal-end side, and a bus bar connecting portion 121*b* which has a flat plate shape and is to be electrically connected to a bus bar (pressure contact blade) 122 is disposed on a tip-end side; a connector housing 123 having terminal accommodating portions 123*a* for accommodating the plurality of terminals 121 in an aligned manner, and a bus bar accommodating portion 123*b*; the bus bar 122 which is accommodated in the bus bar accommodating portion 123*b* so as to electrically interconnect the plurality of terminals 121; and an electric wire 114 connected to the electric wire connecting portion 121*a* of the corresponding terminal 121.

In the example, six terminals 121 which are arranged in upper and lower two lines are interconnected by the bus bar 122. The use of the joint connector 120 allows five branch lines to be obtained.

Each of the terminals 121 is a so-called crimp terminal which is produced by performing a series of plate-working processes such as those of stamping and folding a metal plate having a superior electrically conductive property and a spring property. The electric wire connecting portion 121*a* comprises a cover fixing piece 121*c* for fixing an insulating cover of the electric wire 114 by a compression operation, and a crimping piece 121*d* for crimping a bare wire of the electric wire 114 by a compression operation, similarly to a conventional one.

On the other hand, the tip end portion of the terminal 121 has a simple L-shaped transverse cross section, and has no curved portion or the like which is difficult to be worked. As shown in FIGS. 23 and 25, one flat plate portion which constitutes the L-shape functions as the bus bar connecting portion 121*b* which is engaged with a terminal connecting portion (described later) of the bus bar 122, and the other flat plate portion 121*f* which constitutes the L-shape functions as a retaining portion which is engaged with an engagement projection 123*c* (see FIG. 27 (*a*) and (*b*)) protruding into the terminal accommodating portion 123*a* of the connector housing 123.

The bus bar 122 is made of a metal plate having a superior electrically conductive property. As shown in FIGS. 23 and 26, a plurality of tongue-like terminal connecting portions 122*a* are combined with each other in a comb-like manner so as to correspond to the arrangement (intervals) of the terminals 121 in the connector housing 123. At the center in the width direction (a horizontal direction in FIG. 26) of each of the terminal connecting portions 122*a*, a slit portion 122*b* into which a pair of bus bar connecting portions 121*b* which are disposed in a back-to-back manner are to be tightly fitted is formed. In each of the slit portions 122*b*, the opening is widened on the side closer to the open end thereof, in order that, when the bus bar 122 is inserted into the bus bar accommodating portion 123*b* of the connector housing 123, the bus bar connecting portions 121*b* each having a flat plate shape are guided by the slit portion 122*b*, thereby smoothly attaining the fitting operation. In addition, in order to increase the reliability of electrical contact due to the tight fitting, the slit portion 122*b* has a contact portion 122*c* with a narrowed slit width, at a position where is somewhat inner than the open end.

A slit 122*d* through which a partition wall 123*d* of the connector housing 123 is loosely passed is formed between adjacent terminal connecting portions 122*a*. At positions somewhat closer to the rear end of both sides, engagement pieces 122*e* are protrusively formed. When the bus bar 122 is inserted to a prescribed position in the bus bar accommodating portion 123*b*, each engagement piece 122*e* is engaged with an engagement projection (described later) disposed on the connector housing 123 as shown in FIG. 26, so as to function as a retaining portion.

The connector housing 123 is a mold product of a synthetic resin or the like having a superior insulating property. As shown in FIGS. 123 and 124 and the like, the connector housing 123 has a box-like shape in which the terminal accommodating portions 123*a* for accommodating the plurality of terminals 121 in an aligned manner are formed in upper and lower two lines. The paired terminal accommodating portions 123*a* which are arranged in the upper and lower lines have a vertically communicated structure so that a pair of terminals 121 can be accommodated and held in such a condition that the bus bar connecting portions 121*b* are in close contact in a back-to-back manner.

In the embodiment, therefore, three pairs of upper and lower terminal accommodating portions 123*a* are arranged in the horizontal direction.

The terminal accommodating portions 123*a*, which are horizontally juxtaposed, are separated from each other by partition walls 123*d* that vertically project from the upper and lower outer circumferential walls. As shown in FIGS. 23 and 24, the upper and lower partition walls 123*d* have a configuration in which a portion, positioned at a height at which the bus bar connecting portions 121*b* of the terminals 121 accommodated in each terminal accommodating portion 123*a* are in close contact in a back-to-back manner, is cut out. Accordingly, located at one half of the height of the connector housing 123 (i.e., between the upper and lower terminal accommodating portions 123*a* ), a bus bar accommodating portion 123*b* for accommodating and holding the bus bar 122 is formed. Each of the housing side wall portions which are positioned on both side ends of the bus bar accommodating portion 123*b* is provided with an engaging piece 123*f* which is to be engaged with the engagement piece 122*e* of the bus bar 122 as shown in FIGS. 23 and 26, thereby preventing the bus bar 122 from slipping out.

Both the terminal accommodating portion 123*a* and the bus bar accommodating portion 123*b* are opened at one end of the housing (on the lower side in FIG. 26). The terminals 121 and the bus bar 122 are inserted into the corresponding accommodating portions from the openings at the one end.

When the bus bar 122 is inserted to a prescribed position in the bus bar accommodating portion 123*b* in the same direction as the inserting direction of the terminal 121, the engaging piece 23*f* presses the rear end of the engagement piece 122*e* so as to prevent the bus bar 122 from slipping out.

Figure 27A:
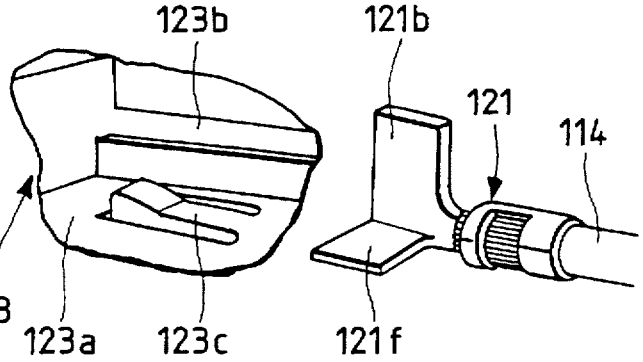
FIGS. 27 (*a*) and (*b*) are perspective views showing an engagement structure for a terminal in a connector housing in the embodiment of the invention.
Figure 27B:
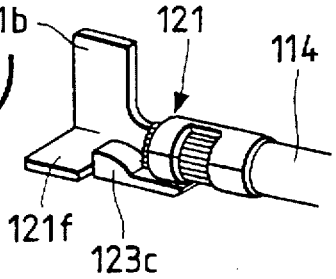

As shown in FIGS. 23 and 25, the upper and lower outer circumferential walls of the connector housing 123 are provided with elastic engagement projections 123*c* which, when the terminals 121 are inserted to a prescribed position in the terminal accommodating portions 123*a*, protrude into the rear of the flat plate portions 121*f* formed on the terminals 121, so as to prevent the terminals 121 from slipping out. In FIG. 27, (*a*) shows a positional relationship between the elastic engagement projection 123*c* and the flat plate portion 121*f* before the terminal 121 is inserted into the terminal accommodating portion 123*a*, and (*b*) shows a positional relationship between the elastic engagement projection 123*c* and the flat plate portion 121*f* after the terminal 121 is completely inserted into the terminal accommodating portion 123*a*.

In the above-described joint connector 120, as shown also in FIG. 24, the bus bar accommodating portion 123*b* for accommodating and holding the bus bar 122 is located at the middle position of the pair of upper and lower terminal accommodating portions 123*a* disposed in the connector housing 123, and remote from the upper and lower outer circumferential walls of the connector housing 123. Accordingly, the upper and lower outer circumferential walls can have a structure in which the partition walls 123*d* for separating the horizontally adjacent terminal accommodating portions 123*a* are projected. The partition walls 123*d* function as reinforcing ribs so as to enhance the rigidity of the upper and lower outer circumferential walls, and to prevent the deflection of the upper and lower outer circumferential walls.

Accordingly, even in the case where the connector housing 123 has a multiple pole structure in which a number of terminal accommodating portions 123*a* are horizontally arranged, the multiple poles can be easily realized without requiring special measures for enhancing the rigidity of the upper and lower outer circumferential walls of the housing.

In addition, a number of terminals 121 which are arranged in upper and lower, configuration two lines can be electrically interconnected by one bus bar 122, and each pair of upper and lower terminals 121 are accommodated and held in the terminal accommodating portion 123*a* in a condition where their bus bar connecting portions 121*b* overlap with each other. Accordingly, the arrangement pitch of the terminals in the vertical direction can be reduced, so that it is possible to mount terminals in a higher density, thereby facilitating miniaturization of the connector.

Figure 28:
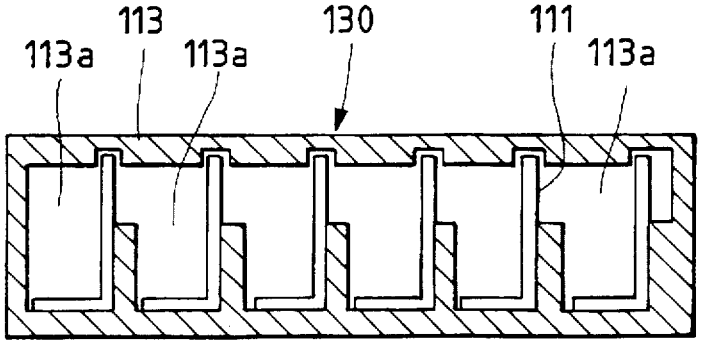
FIG. 28 PRIOR ART
FIG. 28 is a front view showing a packaging density in a conventional joint connector.

For comparison, FIG. 28 shows a front view of a joint connector 130 having a conventional construction and accommodating six terminals which are equal in number to those in the embodiment. As shown in the figure, in the joint connector having the conventional construction, the horizontal length is very large so that the setting area is increased, and the upper outer circumferential wall appears to be not strong.

In addition, since the bus bar connecting portions **121*b* of the pair of upper and lower terminals 121 are in close contact in a back-to-back manner, the thickness of bus bar 122 which is fitted into the slit portion 122*b* can be doubled. Accordingly, even if the bus bar connecting portions 121*b* are not folded, it is possible to ensure a sufficient thickness for the bus bar connecting portions 121*b* which are fitted into the slit portion 122*b* of the bus bar 122**.

Therefore, it is unnecessary to perform the folding process for increasing the thickness of the bus bar connecting portions **121*b***, and it is possible to facilitate the lowering of the production cost by a reduction in the press dies and labor costs.

The tip end portion of the terminal 121 has an L-shape. Therefore, it is possible to ensure a high strength on the tip-end side of the terminal although the L-shape has a simple shape. Moreover, the design can be more freely manufactured. For example, one of two perpendicular flat plate portions is used for the connection with the bus bar, and the other portion is used for the positioning in the connector housing.

The number of terminals accommodated in the joint connector of the invention is not limited to that in the above-mentioned embodiment, and can be variably designed as required.

According to the joint connector of the invention, the bus bar accommodating portion for accommodating and holding the bus bar can be located at the middle position of the pair of upper and lower terminal accommodating portions disposed in the connector housing, and remote from the outer circumferential wall of the connector housing. Accordingly, the upper and lower outer circumferential walls can have a structure in which partition walls for separating the horizontally adjacent terminal accommodating portions are projected. The partition walls function as reinforcing ribs, so as to enhance the rigidity of the upper and lower outer circumferential walls, and to prevent the deflection of the upper and lower outer circumferential walls.

Accordingly, even in the case where the connector housing has a multiple pole structure in which a number of terminal accommodating portions are horizontally arranged, the multiple poles can be easily realized without requiring special measures for enhancing the rigidity of the upper and lower outer circumferential walls of the housing.

In addition, a number of terminals which are arranged in upper and lower two lines can be electrically interconnected by one bus bar, and each pair of upper and lower terminals are accommodated and held in the terminal accommodating portion in a condition where their bus bar connecting portions overlap with each other. Accordingly, the arrangement pitch of the terminals in the vertical direction can be reduced, so that it is possible to mount terminals in a higher density, thereby facilitating miniaturization of the connector.

Moreover, the bus bar connecting portions of the pair of upper and lower terminals are in close contact in a back-to-back manner, so that the thickness which is fitted into one slit portion of the bus bar can be doubled. Accordingly, even if the bus bar connecting portions are not folded, it is possible to ensure a sufficient thickness for the bus bar connecting portions which are fitted into the slit portion of the bus bar.

Therefore, it is unnecessary to perform the folding process for increasing the thickness of the bus bar connecting portions, and it is possible to facilitate the lowering of the production cost by reducing the press dies and the work cost.

The tip end portion of the terminal has an L-shape. Therefore, it is possible to ensure a high strength on the tip-end side of the terminal although the terminal has a simple shape. Moreover, the design can be more freely performed. For example, one of two perpendicular flat plate portions is used for the connection with the bus bar, and the other portion is used for the positioning in the connector housing.

What is claimed is:

1. A joint connector, comprising:

a plurality of terminals each having a wire connecting portion at a rear end, and a bus bar connecting portion at a front end;

a connector housing including terminal accommodating sections in which said terminals are accommodated, and a bus bar accommodating section;

a bus bar disposed in said bus bar accommodating section, said bus bar including a plurality of terminal connecting portions arranged in correspondence to said terminals arranged in said connector housing which are engaged with said bus bar connecting portions of said terminals so as to be electrically connected to said terminals whereby said terminals are electrically connected to one another, wherein each of said bus bar connecting portions of said terminals includes one of a planar member and slit means for receiving a planar member and each of said terminal connecting portions of said bus bar includes another of said planar member and said slit means, said planar member being engaged with said slit means so that each of said bus bar connecting portions of said terminals are electrically connected to each of said terminal connecting portions of said bus bar, wherein each of said bus bar connecting portions of said terminals is L-shaped including first and second plate-like members, said first plate-like member corresponding to said planar member.

2. The joint connector of claim 1, wherein each of said terminal accommodating sections includes a locking protrusion which is engaged by said second plate-like member of each of said terminals to retain said terminals in said terminal accommodating sections.

3. The joint connector of claim 1, wherein said terminal accommodating sections formed in said connector housing has a structure in which a pair of terminal accommodating sections are vertically juxtaposed and communicated with each other, said pair of terminal accommodating portions accommodating and holding a pair of terminals in a condition where bus bar connecting portions of said pair of terminals are in close contact in a back-to-back manner, and said bus bar connecting portions which are in close contact in a back-to-back manner are sandwiched by a slit portion of said terminal connecting portions of said bus bar.

4. The joint connector of claim 1, wherein a tip end portion of said terminal has an L-shape in a transverse cross section, one of flat plate portions which constitutes said L-shape is used as said bus bar connecting portion which is to be engaged with said terminal connecting portion of said bus bar, and the other flat plate portion which constitutes said L-shape is used as a retaining portion which is to be engaged with an elastic engagement projection protruding into said terminal accommodating sections of said connector housing.

5. The joint connector of claim 1, wherein said bus bar has protruding elastic engaging pieces disposed at both side ends, and said engaging pieces are to be respectively engaged with engagement pieces formed on housing side wall portions corresponding to said bus bar accommodating sections, thereby preventing said bus bar from slipping out from said connector housing.

6. A joint connector, comprising:

a plurality of terminals, extending in a longitudinal direction, each having a wire connecting portion provided at a rear end, and base plate portion and a bus bar connecting portion provided at a front end, said bus bar connecting portion including a pair of planar tabs extending from opposite sides of said base plate portion which are joined together to form a laminated plate-like member;

a connector housing including terminal accommodating sections in which said terminals are accommodated, and a bus bar accommodating section;

a bus bar disposed in said bus bar accommodating section, said bus bar including a plurality of terminal connecting portions each including a slit for receiving the laminated plate-like member such that said terminals are electrically connected to one another through said bus bar.

7. The joint connector of claim 6, wherein for each said plurality of terminals said bus bar connecting portion is aligned with an electric wire secured to said wire connecting portion of said terminal in a lateral direction.

8. The joint connector of claim 6, wherein when said terminals are inserted into the respective terminal accommodating sections said base plate portion of said terminals slides along a bottom surface of said terminal accommodating sections.

9. The joint connector of claim 6, wherein said base plate portion of each of said terminals has a locking hole which, when an associated terminal has been inserted into the respective terminal accommodating section of said connector housing to a predetermined position, is engaged with a locking protrusion which is formed on a bottom of said terminal accommodating section, wherein said locking hole is centrally aligned with an electrical wire fixedly connected to said terminal connecting portion of said terminal.

10. The joint connector of claim 6, wherein said bus bar is buried in a spacer made of a insulating resin.

11. The joint connector of claim 6, where for said laminated plate like member one of said planar tabs is folded over the other of said planar tabs so as to sandwich said other planar tab.

12. The joint connector of claim 11, wherein the fold extends in a direction parallel to said longitudinal direction.

13. The joint connector of claim 11, wherein the fold extends in a direction perpendicular to said longitudinal direction.

14. A joint connector, comprising:

a plurality of terminals each having a wire connecting portion at a rear end, and a bus bar connecting portion at a front end;

a connector housing including;

terminal accommodating sections in which said terminals are accommodated, and a bus bar accommodating section; and, a bus bar disposed in said bus bar accommodating section, said bus bar including a plurality of terminal connecting portions arranged in correspondence to said terminals arranged in said connector housing which are engaged with said bus bar connecting portions of said terminals so as to be electrically connected to said terminals whereby said terminals are electrically connected to one another.

wherein each of said bus bar connecting portions of said terminals includes one of a planar member and slit means for receiving a planar member and each of said terminal connecting portions of said bus bar includes another of said planar member and said slit means, said planar member being engaged with said slit means so that each of said bus bar connecting portions of said terminals are electrically connected to each of said terminal connecting portions of said bus bar;

wherein said terminal accommodating sections formed in said connector housing has a structure in which a pair of terminal accommodating sections are vertically juxtaposed and communicated with each other, said pair of terminal accommodating portions accommodating and holding a pair of terminals in a condition where bus bar connecting portions of said pair of terminals are in close contact in a back-to-back manner, and said bus bar connecting portions which are in close contact in a back-to-back manner are sandwiched by a slit portion of said terminal connecting portions of said bus bar.

15. The joint connector of claim 14, wherein said bus bar has protruding elastic engaging pieces disposed at both side ends, and said engaging pieces are to be respectively engaged with engagement pieces formed on housing side wall portions corresponding to said bus bar accommodating sections, thereby preventing said bus bar from slipping out from said connector housing.

16. A joint connector, comprising:

a plurality of terminals each having a wire connecting portion at a rear end, and a bus bar connecting portion at a front end;

a connector housing including;

terminal accommodating sections in which said terminals are accommodated;

a bus bar accommodating section; and a bus bar disposed in said bus bar accommodating section, said bus bar including a plurality of terminal connecting portions arranged in correspondence to said terminals arranged in said connector housing which are engaged with said bus bar connecting portions of said terminals so as to be electrically connected to said terminals whereby said terminals are electrically connected to one another;

wherein each of said bus bar connecting portions of said terminals includes one of a planar member and slit means for receiving a planar member and each of said terminal connecting portions of said bus bar includes another of said planar member and said slit means, said planar member being engaged with said slit means so that each of said bus bar connecting portions of said terminals are electrically connected to each of said terminal connecting portions of said bus bar;

and wherein a tip end portion of each of the said terminals has an L-shape in a transverse cross section, one of flat plate portions which constitutes said L-shape is used as said bus bar connecting portion which is to be engaged with said terminal connecting portion of said bus bar, and the other flat plate portion which constitutes said L-shape is used as a retaining portion which is to be engaged with an elastic engagement projection protruding into said terminal accommodating sections of said connector housing.

17. The joint connector of claim 16, wherein said bus bar has protruding elastic engaging pieces disposed at both side ends, and said engaging pieces are to be respectively engaged with engagement pieces formed on housing side wall portions corresponding to said bus bar accommodating sections, thereby preventing said bus bar from slipping out from said connector housing.

* * * * *